US005088888A

United States Patent [19]

Bobo

[11] Patent Number: 5,088,888

[45] Date of Patent: Feb. 18, 1992

[54] SHROUD SEAL

[75] Inventor: Melvin Bobo, Cincinnati, Ohio

[73] Assignee: General Electric Company, Cincinnati, Ohio

[21] Appl. No.: 621,149

[22] Filed: Dec. 3, 1990

[51] Int. Cl.[5] ..... F04D 29/08

[52] U.S. Cl. ..... 415/170.1; 415/134; 415/138; 415/139; 277/5; 277/138

[58] Field of Search ..... 415/170.1, 174.2, 134, 415/135, 136, 137, 138, 139, 229-231; 277/5, 160, 138; 220/437, 438

[56] References Cited

U.S. PATENT DOCUMENTS

| | | | |
|---|---|---|---|
| 2,197,983 | 4/1940 | Phillips | 277/160 |
| 2,863,634 | 12/1958 | Chamberlin et al. | 415/134 |
| 2,991,045 | 7/1961 | Tassoni | 415/135 |
| 3,056,607 | 10/1962 | Knoebel | 277/160 |
| 3,520,635 | 7/1970 | Killmann et al. | 415/173.1 |
| 3,754,766 | 8/1973 | Asplund | 415/173.7 |
| 3,970,318 | 7/1976 | Tuley | 277/26 |
| 3,975,114 | 8/1976 | Kalkbrenner | 415/217 |
| 4,013,376 | 3/1977 | Bisson et al. | 415/117 |
| 4,063,845 | 12/1977 | Allen | 415/134 |
| 4,359,310 | 11/1982 | Endres et al. | 415/115 |
| 4,537,024 | 8/1985 | Grosjean | 60/39.161 |
| 4,643,438 | 2/1987 | Klusowski et al. | 277/138 |
| 4,650,394 | 3/1987 | Weidner | 415/115 |
| 4,720,236 | 1/1988 | Stevens | 415/134 |
| 4,767,260 | 8/1988 | Clevenger et al. | 415/115 |
| 4,989,886 | 2/1991 | Rulis | 415/173.3 |

*Primary Examiner*—John T. Kwon

*Attorney, Agent, or Firm*—Jerome C. Squillaro; Charles L. Moore, Jr.

[57] ABSTRACT

To prevent overheating of the gaps between shroud segments circumferentially arranged about a high pressure turbine rotor, an improved seal is provided to block radial leakage flow of hot working gas through the gaps, as well as to restrict axial flow of working gas in the gaps. The seal includes a corrugated, axial fluid flow restricting element sandwiched between a pair of radially spaced, gap spanning shim sealing elements. Pressurized cooling air is admitted to the gap at locations between the shim sealing elements via passages through adjacent shroud segments to cool the gap and to further restrict working gas axial flow in the gap.

13 Claims, 2 Drawing Sheets

SHROUD SEAL

The present invention relates to gas turbine engines and particularly to sealing the gaps between shroud segments circumferentially arrayed about the rotor in the high pressure turbine section of a gas turbine engine.

BACKGROUND OF THE INVENTION

To increase the efficiency of gas turbine engines, a known approach is to raise the turbine operating temperatures. As operating temperatures are increased, the thermal limits of certain engine components may be exceeded, resulting in material failures or, at the very least, reduced service life. In addition, the increased thermal expansion and contraction of these components adversely effects clearances and their interfitting relationships with other components of different thermal coefficients of expansion. Consequently, these components must either be cooled or limited in their exposure to the high temperature working gas to avoid potentially damaging consequences at elevated operating temperatures. It is common practice to extract from the main airstream a portion of the compressed air at the output of the compressor for cooling purposes. So as not to unduly compromise the gain in engine operating efficiency achieved through higher operating temperatures, the amount of extracted cooling air should be held to a small percentage of the total main airstream. This requires that the cooling air be utilized with utmost efficiency in maintaining the temperatures of these components within safe limits.

A particularly critical component subjected to extremely high temperatures is the shroud located immediately downstream from the high pressure turbine nozzle from the combustor. The shroud closely surrounds the rotor of the high pressure turbine and thus defines the outer boundary for the extremely high temperature, energized working gas stream flowing through the high pressure turbine. To prevent material failure and to maintain proper clearance with the rotor blades of the high pressure turbine, adequate shroud cooling is a critical concern.

High pressure turbine shrouds are typically formed as a circumferential array of arcuate shroud segments. Gaps are provided between adjacent shroud segments to accommodate differential thermal expansion of the shroud segments and their supporting structure. As these axially and radially extending gaps are exposed to the working gas stream on their radially inner sides and typically cooling air on their radially outer sides, they must be sealed. The gap seals should be of a character to minimize the leakages of working gas and cooling air radially through the gaps and also accommodate variations in the gap width due to thermal expansion and contraction.

There are numerous examples of shroud seals in the prior art that are effect we in minimizing radial leakages of working gas and cooling air. Unfortunately, these conventional seals are not effective in limiting the axial flow of working gas in the gaps. That is, the gaps are typically open at their fore (upstream) and aft (downstream) ends, and, consequently, working gas enters the fore ends of the gaps, flows axially in the gaps due to pressure differential and exits their aft ends. The edges of the shroud segments defining the inter-segment gaps are thus heated by the working gas to extremely high temperatures damaging to the shroud material integrity. These gaps must therefore be cooled. To this end, U.S. Pat. Nos. 4,650,394 and 4,767,260 propose using perforated gap seals to accommodate a metered flow of high pressure cooling air radially through the gap for cooling the shroud segment edges, as well as disrupting the axial flow of working gas in the gaps. This approach is inefficient, as it requires a significant quantity of cooling air to achieve the intended purpose.

It is accordingly an object of the present invention to provide an improved shroud seal in gas turbine engines.

A further object is to provide a shroud seal of the above-character which minimizes the leakages of hot working gas and cooling air radially through the gaps between segments of the shroud in the high pressure turbine section of a gas turbine engine.

An additional object is to provide a seal of the above-character, wherein the axial flow of hot working gas in the shroud segment gaps is minimized.

Another object is to provide a seal of the above-character, which accommodates efficient cooling of the shroud edges defining the inter-segment gaps.

A still further object is to provide a seal of the above-character, which accommodates variations in the inter-segment gap width due to thermal expansion and contraction.

Other objects of the invention will in part be obvious and in part appear hereinafter.

SUMMARY OF THE INVENTION

In accordance with the present invention, there is provided an improved seal for the gaps between segments of a shroud circumstantially arranged about the rotor in the high pressure turbine section of a gas turbine engine. The improved seal includes an elongated first shim sealing element received in opposed, axially elongated slots formed in the radial end surfaces of adjacent shroud segments defining a gap. An elongated second shim sealing element is received in opposed, axially elongated slots also formed in the gap-defining shroud segment surfaces. The first and second shim sealing elements are in radially spaced relation, such that the radially inner first sealing element blocks the leakage of hot working gas radially outward through the gap, while the radially outer second sealing element blocks the radially inward leakage of pressurized cooling air through the gap.

To minimize the axial flow of hot working gas in the inter-shroud segment gap, a flow restricting element is disposed in the gap between the first and second shim sealing elements. In the preferred embodiment, this restricting element is in the form of an elongated strip of a corrugated or wavy configuration and is arranged with the crests of the corrugations bearing against the shroud segment end surfaces defining the gap.

As a further feature of the invention, the gap is cooled by pressurized cooling air admitted to the space between the first and second shim sealing elements through passages in the shroud segments. The admitted cooling air also creates a slightly higher pressure region in the gap to further discourage the axial flow of working gas in the gap.

The invention accordingly comprises the features of construction, combination of elements, and arrangement of parts, all as detailed below, and the scope of the invention will be indicated in the claims.

For a full understanding of the nature and objects of the invention, reference may be had to the following Detailed Description, taken in conjunction with the accompanying drawings, in which.

Corresponding reference numerals refer to like parts throughout the several views of the drawings.

DETAILED DESCRIPTION

Figure 1:
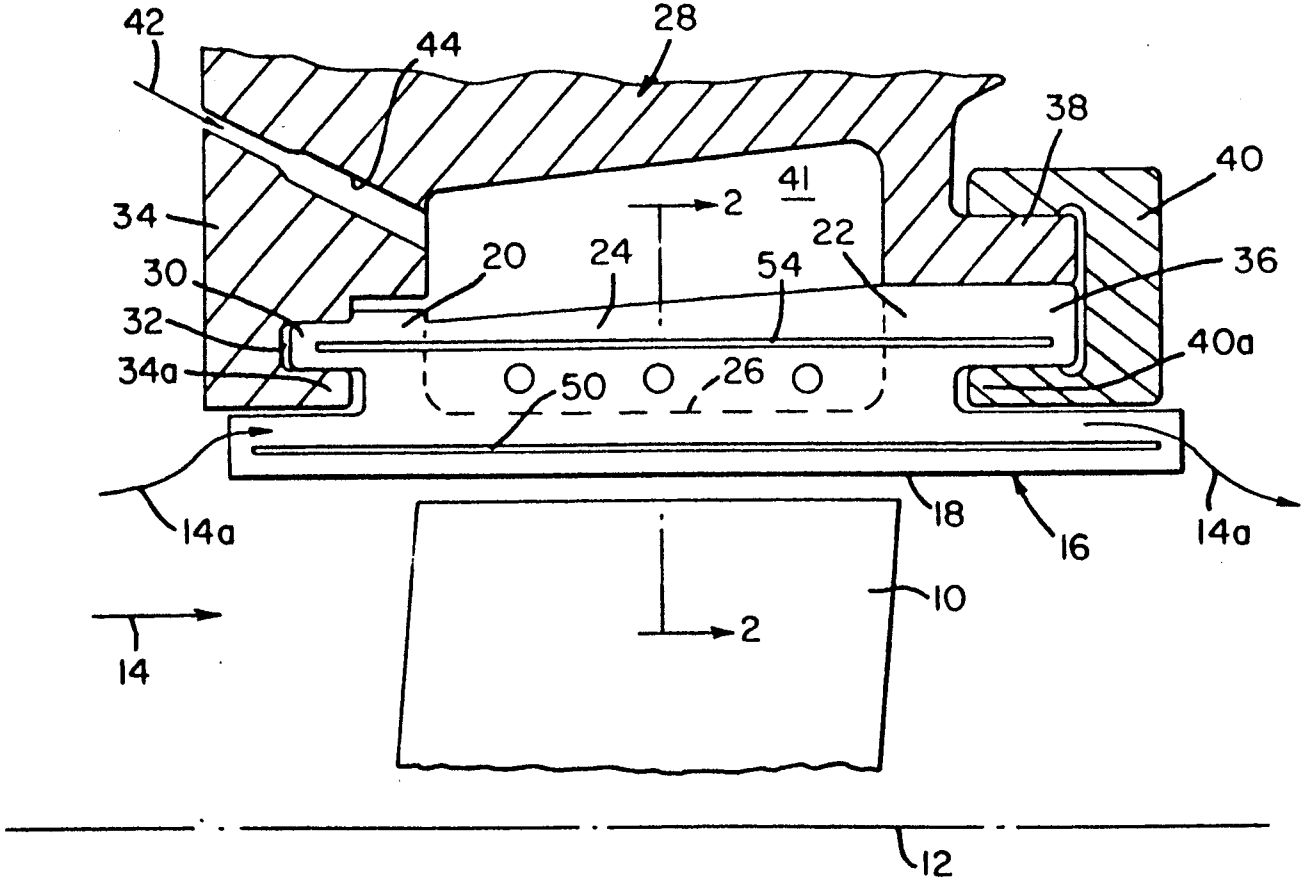
FIG. 1 is a fragmentary, axial sectional view of a portion of the high pressure turbine section in a gas turbine engine.

The portion of the high pressure turbine section of a gas turbine engine seen in FIGURE I depicts a shroud closely surrounding the turbine rotor including a plurality of blades, one indicated at 10, revolving about an engine centerline 12. The shroud, which defines the outer boundary for the working gas stream flowing generally axially through the turbine section (arrow 14), is comprised of an circumferential array of shroud sections, one generally indicated at 16. Each shroud segment includes a base 18 and integral, radially outwardly projecting fore and aft rails 20 and 22, respectively. These rails are integrally joined by radially outwardly projecting, circumstantially spaced siderails 24 to define a shroud segment cavity 26. The shroud segments are mounted in position by a hanger 26, which would also be provided in segments in the case of engines designed for high temperature operation. The hanger, in turn, is supported by the engine outer case (not shown). As illustrated, each shroud section fore rail 20 is provided with a forwardly extending flange 30 which is received in notch 32 formed in a radially inwardly extending hanger rail 34. A rearward flange extension 36 of shroud segment aft rail 22 is held in lapped relation with a hanger flange 38 by a C-shaped retainer ring 40 to complete the shroud segment mountings. Each hanger segment 28 provides with one or more shroud segment cavities 26 a plenum chamber 41 into which pressurized cooling air is introduced (arrow 42) through metering holes 44 drilled through the hanger section rail 34. While not shown, a perforated baffle is preferably positioned in each shroud segment cavity to provide impingement cooling of the base 18.

Figure 2:
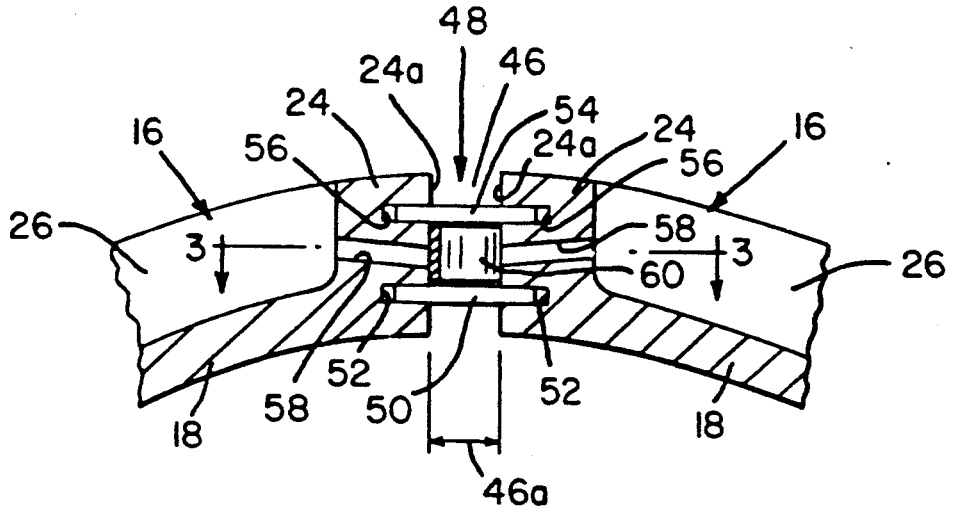
FIG. 2 is a sectional view taken along line 2—2 of FIGURE 1, showing an inter-shroud segment gap seal constructed in accordance with the present invention.
Figure 3:
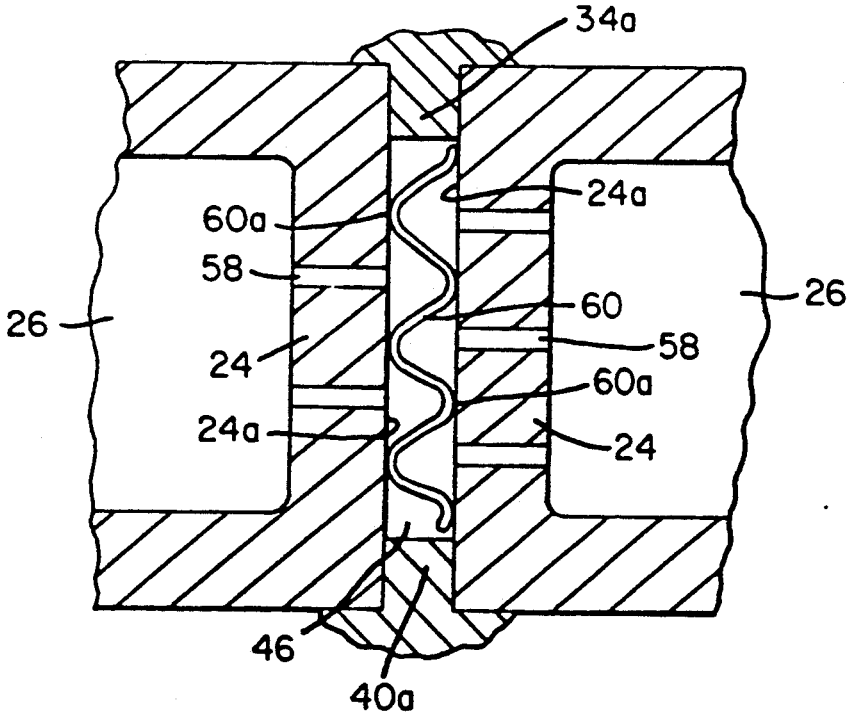
FIG. 3 is a sectional view taken along line 3—3 of FIG. 2.

Turning to FIGS. 2 and 3, the shroud segments 16 are mounted with gaps 46 between circumferentially adjacent segments to accommodate differential thermal expansion of the shroud and supporting structure. As a consequence, the gap width **46*a* varies with engine operating temperature. To close the gaps 46 between shroud segments, seals, generally indicated at 48, are incorporated therein. Each seal includes an elongated metal shim or strip 50 as a sealing element to block the flow of hot working gas radially outward through the gap. The lateral edges of shim sealing element 50 are received in opposed slots 52 in the confronting radial end surfaces 24*a* of the adjacent shroud segment siderails 24. To block the radially inward flow of pressurized cooling air, each seal includes a second shim sealing element 54 positioned radially outwardly of sealing element 50 with its lateral edges received in opposed slots 56 in the shroud segment siderail surfaces 24*a*. As seen in FIG. 1, the radially spaced sealing elements 50 and 54 extend substantially the full axial length of the shroud elements. It will be noted that, while seals 48 are effective in blocking radial leakage of the working gas, they are substantially open-ended fore and aft. Consequently, working gas can and indeed does flow axially in gaps 46 between sealing elements 50 and 54, as indicated by arrows 14*a* in FIG. 1. The shroud segment siderails 24 and particularly their gap-defining surfaces 24*a*** are exposed to high working gas temperatures and thus are subject to deterioration, burning, oxidation, etc.

To cool the gaps, passages 58 are drilled through siderails 24 from the shroud segment cavities 26 to admit pressurized cooling air from plenum chamber 41. The cooling air convection cools the siderails through which it flows in passages 58.

In accordance with a signal feature of the present invention, axial flow of the hot working gas in the gaps 46 is restricted by the inclusion of a flow restricting element 60 in the space between shim sealing elements 50 and 54. As seen in FIG. 3, flow restricting element 60 is preferably in the form of an elongated metallic strip having a wavy or corrugated configuration. The effective width of elements 60 is such as to fully span the gap with its alternating crests **60*a* in engagements with gap-defining siderail surfaces 24*a*. The element height is slightly less than the radial spacing between shim sealing elements 50, 54, and their length is somewhat less than the axial separation between hanger rail projection 34*a* and retainer ring arm 40*a*, which serve to maintain the flow restricting elements in place (FIGS. 1 and 3). The elements 60, as well as the sealing elements, are preferably of a high temperature strength, oxidation resistant material, such as a cobalt base alloy. At least the flow restricting elements should be somewhat resilient to react to variations in gap width 46*a*. In this connection, sufficient clearance between projections 34*a* and 40*a* should be provided to accommodate axial elongation of the flow restricting elements as the gap width closes to the anticipated minimum dimension. In addition, the depths of slots 52, 56 are sufficient to preclude distortion of the shim sealing elements 50, 54** in which would jeopardize their sealing effectiveness at the minimum gap dimension.

From the foregoing description, it is seen that the inclusion of flow restricting element 60 in seal 48 effectively minimizes the axial flow of hot working gas in gap 46 between shim sealing elements 50, 54. Consequently, excessive heating of siderails 24 is avoided. Moreover, the flow restricting element also serves to limit the leakage flow of cooling air axially in the gap between the sealing and restricting elements. More efficient shroud cooling is thus achieved, as less cooling air is required to cool gaps 46. Since the admitted cooling air pressurizes the region of the gap between sealing elements, the axial flow of working gas in the gaps is further discouraged. As seen in FIG. 3, the positions of the cooling air passages 58 in the confronting siderails 24 of adjacent shroud segments are preferably staggered so that their exits are not blocked by the crests **60*a*** of the flow restricting elements. While these elements are shown having a corrugated shape, they may be of alternative configurations, such as, for example, accordion-shaped.

It is seen that the objects set forth above, including those made apparent from the foregoing Detailed Description, are efficiently attained, and, since certain changes may be made in the construction set forth without departing from the scope of the invention, it is intended that matters of detail be taken as illustrative and not in a limiting sense.

Having described the invention, what is claimed as new and desired to secure by Letters Patent is:

1. In a segmented annular shroud for confining the axial flow of hot working gas in a gas turbine engine, a seal for blocking radial leakage flow of working gas through a gap between adjacent shroud segments, and seal comprising, in combination:

A. a first axially elongated strip sealing element spanning the gap and having lateral edges received in opposed first slots formed in confronting, gap-defining, radial surfaces of adjacent shroud segments;

B. a second, axially elongated strip sealing element spanning the gap and having lateral edges received in opposed second slots formed in said confronting, gap-defining, radial surfaces of the adjacent shroud segments, said second sealing element being in radially spaced relation with said first sealing element; and C. a flow restricting element disposed between said first and second sealing elements to restrict the axial flow of hot working gas in the gap between said first and second sealing elements.

2. The seal defined in claim 1, wherein said flow restricting element is axially elongated to extend over a substantial portion of the axial length of the shroud segments.

3. The seal defined in claim 2, wherein said flow restricting element is corrugated in the direction of axial elongation.

4. The seal defined in claim 3, wherein said corrugated flow restricting element includes corrugations with crests of alternating said corrugations engaging said confronting, gap-defining radial surfaces of the adjacent shroud segments.

5. The seal defined in claim 4, wherein said corrugated flow restricting element is formed of a material of sufficient resiliency to accommodate variations in the width of the gap.

6. The seal defined in claim 1, which further includes passages formed in at least one of the adjacent shroud segments for introducing pressurized cooling air into the gap between said first and second sealing elements.

7. The seal defined in claim 6, wherein said flow restricting element is axially elongated to extend over a substantial portion of the axial length of the shroud segments.

8. The seal defined in claim 7, wherein said flow restricting element is corrugated in the direction of axial elongation.

9. The seal defined in claim 8, wherein said corrugated flow restricting element includes corrugations with crests of alternating said corrugations engaging said confronting, gap-defining radial surfaces of the adjacent shroud segments.

10. The seal defined in claim 9, wherein said corrugated flow restricting element is formed of a material of sufficient resiliency to accommodate variations in the width of the gap.

11. The seal defined in claim 9, wherein said cooling passages are formed in both of the adjacent shroud segments and have exits at said confronting, gap-defining radial surfaces of the adjacent shroud segments.

12. The seal defined in claim 11, wherein said cooling passage exits are distributed over the axial length of said confronting, gap-defining radial surfaces of the adjacent shroud segments.

13. The seal defined in claim 12, wherein said cooling passage exits are axial located such as to avoid obstruction by said corrugation crests of said flow restricting element.

* * * * *